US011369239B2

(12) United States Patent
Yang

(10) Patent No.: US 11,369,239 B2
(45) Date of Patent: Jun. 28, 2022

(54) TELESCOPIC TOILET FOR CHILDREN

(71) Applicant: XIAMEN BABY PRETTY PRODUCTS CO., LTD., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 0 days.

(21) Appl. No.: 17/244,982

(22) Filed: Apr. 30, 2021

(65) Prior Publication Data

US 2022/0160191 A1 May 26, 2022

(30) Foreign Application Priority Data

Nov. 24, 2020 (CN) ..... 202022731432.2

(51) Int. Cl.
*A47K 11/04* (2006.01)

(52) U.S. Cl.
CPC ..... *A47K 11/04* (2013.01)

(58) Field of Classification Search
CPC ..... A47K 11/04; A47K 11/06
USPC ..... 4/483
See application file for complete search history.

(56) References Cited

U.S. PATENT DOCUMENTS 1,663,966 A * 3/1928 Ament ..... A47K 11/06 220/9.3
8,499,370 B1 * 8/2013 Felicetta ..... A47K 11/04 4/479
2008/0178379 A1 * 7/2008 Davis ..... A47K 11/06 4/483
2009/0255044 A1 * 10/2009 Pokorski ..... A47K 11/04 4/483
2015/0265109 A1 * 9/2015 Capraro ..... E05D 11/1007 4/239

* cited by examiner

*Primary Examiner* — Huyen D Le
(74) *Attorney, Agent, or Firm* — Bayramoglu Law Offices LLC

(57) ABSTRACT

A telescopic toilet for children includes a base and a seat. A first sleeve ring is fixed on the base, and a second sleeve ring is provided in the first sleeve ring. The second sleeve ring is liftable relative to the first sleeve ring, and a third sleeve ring is provided in the second sleeve ring. The third sleeve ring is liftable relative to the second sleeve ring, and a fourth sleeve ring is provided in the third sleeve ring. The bottom of the seat is fixedly connected to the fourth sleeve ring, and the fourth sleeve ring is liftable relative to the third sleeve ring. The seat is provided with a toilet bowl opening. The seat can be adjusted to different heights according to the height of children.

10 Claims, 7 Drawing Sheets

TELESCOPIC TOILET FOR CHILDREN

CROSS REFERENCE TO THE RELATED APPLICATIONS

This application is based upon and claims priority to Chinese Patent Application No. 202022731432.3, filed on Nov. 24, 2020, the entire contents of which are incorporated herein by reference.

TECHNICAL FIELD

The present invention relates to the field of children products, and in particular to a telescopic toilet for children.

BACKGROUND

Children frequently encounter many problems when using a toilet due to their personal physical stature. If the toilet is too high, children feel awkward when sitting on the toilet. If the toilet is too wide, children will experience much discomfort when sitting on the toilet with two legs apart. Moreover, since an adult-sized toilet has a relatively large seat, children's bums are likely to fall in and/or get stuck in the seat, which is not safe to use. If children frequently use a toilet with their bums inside the toilet seat, it will cause negative effects on their physical growth. At present, there are various styles of children's toilets available on the market in order to provide convenience for children, but these toilets have a fixed height rather than an adjustable height, and thus cannot meet the usability needs of specific children varying in height. If the toilet is too high, some children feel uncomfortable when sitting on the toilet with their feet dangling on the ground. If the toilet is too low, some children either bend their legs dramatically or stretch out their feet, which causes discomfort to children during the use of the toilet.

SUMMARY

The present invention provides a telescopic toilet for children to overcome the above-mentioned problems identified in the prior art.

The present invention is realized by adopting the following technical solution.

A telescopic toilet for children includes a base and a seat. A first sleeve ring is fixed on the base, and a second sleeve ring is provided in the first sleeve ring. The second sleeve ring is liftable relative to the first sleeve ring, and a third sleeve ring is provided in the second sleeve ring. The third sleeve ring is liftable relative to the second sleeve ring, and a fourth sleeve ring is provided in the third sleeve ring. The bottom of the seat is fixedly connected to the fourth sleeve ring, and the fourth sleeve ring is liftable relative to the third sleeve ring. The seat is provided with a toilet bowl opening.

Further, the top surface of the base is provided with a receiving groove, and a plurality of first hooks are provided in the receiving groove. The lower part of the first sleeve ring is located in the receiving groove, and the bottom periphery of the first sleeve ring is provided with a plurality of first clamping parts. Each first hook corresponds to one first clamping part, and each first hook is configured to hook the top surface of the corresponding first clamping part.

Further, a plurality of first sliding slots are evenly distributed on the periphery of the first sleeve ring. The first sliding slot includes a first vertical sliding slot and a first arc-shaped sliding slot located on one side of the first vertical sliding slot. The first arc-shaped sliding slot is connected to the top of the first vertical sliding slot through an arc transition. A plurality of first protruding columns are evenly distributed on the lower periphery of the second sleeve ring, and each first protruding column corresponds to one first sliding slot. The first protruding column is liftable in the first vertical sliding slot and can be engaged in the first arc-shaped sliding slot.

Further, a plurality of second sliding slots are evenly distributed on the periphery of the second sleeve ring. The second sliding slot includes a second vertical sliding slot and a second arc-shaped sliding slot located on one side of the second vertical sliding slot. The second arc-shaped sliding slot is connected to the top of the second vertical sliding slot through an arc transition. A plurality of second protruding columns are evenly distributed on the lower periphery of the third sleeve ring, and each second protruding column corresponds to one second sliding slot. The second protruding column is liftable in the second vertical sliding slot and can be engaged in the second arc-shaped sliding slot.

Further, a plurality of third sliding slots are evenly distributed on the periphery of the third sleeve ring. The third sliding slot includes a third vertical sliding slot and a third arc-shaped sliding slot located on one side of the third vertical sliding slot. The third arc-shaped sliding slot is connected to the top of the third vertical sliding slot through an arc transition. A plurality of third protruding columns are evenly distributed on the lower periphery of the fourth sleeve ring, and each third protruding column corresponds to one third sliding slot. The third protruding column is liftable in the third vertical sliding slot and can be engaged in the third arc-shaped sliding slot.

Further, the first protruding column, each of the second protruding column and the third protruding column includes a cylinder and a semicircular part provided at the lower half of the front end of the cylinder. The diameter of the semicircular part is greater than the diameter of the cylinder. Each of the first vertical sliding slot, the second vertical sliding slot and the third vertical sliding slot includes a vertical cylinder sliding slot and a vertical semicircular part sliding slot. The vertical cylinder sliding slot fits with the cylinder, and the vertical semicircular part sliding slot fits with the semicircular part. Each of the first arc-shaped sliding slot, the second arc-shaped sliding slot and the third arc-shaped sliding slot includes a cylinder arc-shaped sliding slot and a semicircular part arc-shaped sliding slot. The cylinder arc-shaped sliding slot fits with the cylinder, and the semicircular part arc-shaped sliding slot fits with the semicircular part. The cylinder arc-shaped sliding slot is connected to the vertical cylinder sliding slot through an arc transition, and the semicircular part arc-shaped sliding slot is connected to the vertical semicircular part sliding slot through an arc transition.

Further, the top periphery of the fourth sleeve ring is provided with a plurality of second clamping parts, and the top surface of the fourth sleeve ring is provided with a plurality of inserting parts. The bottom of the seat is provided with a plurality of second hooks and a plurality of slots. Each second hook corresponds to one second clamping part, and each second hook is configured to hook the bottom surface of the corresponding second clamping part. Each inserting part corresponds to one slot, and each inserting part is inserted into the corresponding slot.

Further, the top surface of the seat is provided with a cover plate for covering the toilet bowl opening.

Further, a plurality of sets of support plates are arranged on the periphery of the first sleeve ring, and the plurality of sets of support plates abut against the bottom of the seat.

Further, the bottom surface of the base is provided with a plurality of anti-slip strips, and the rear end surface of the seat is provided with a handle groove.

It can be seen from the above description of the present invention that the present invention has the following advantages over the prior art. The present invention has a novel structure and ingenious design. Specifically, the fourth sleeve ring is liftable relative to the third sleeve ring, the third sleeve ring is liftable relative to the second sleeve ring, and the second sleeve ring is liftable relative to the first sleeve ring. In this way, the seat can be adjusted at different heights according to the height of children. The toilet not only provides a more comfortable experience for children during the use of the toilet, but also broadens the recommended age group of users.

DETAILED DESCRIPTION OF THE EMBODIMENTS

Figure 1:
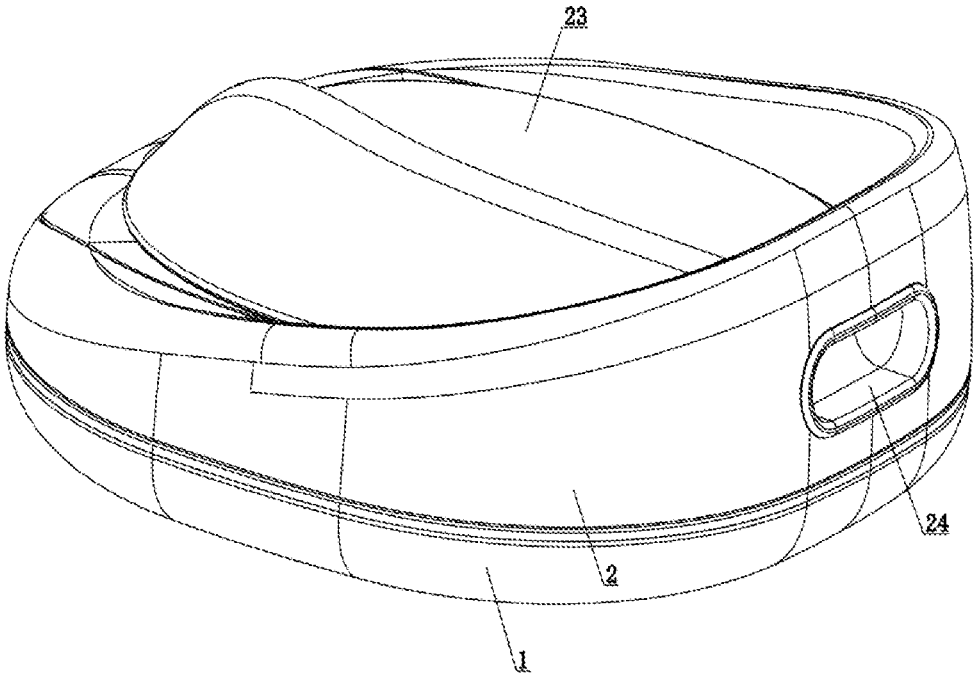
FIG. 1 is a structural diagram of the present invention.
Figure 2:
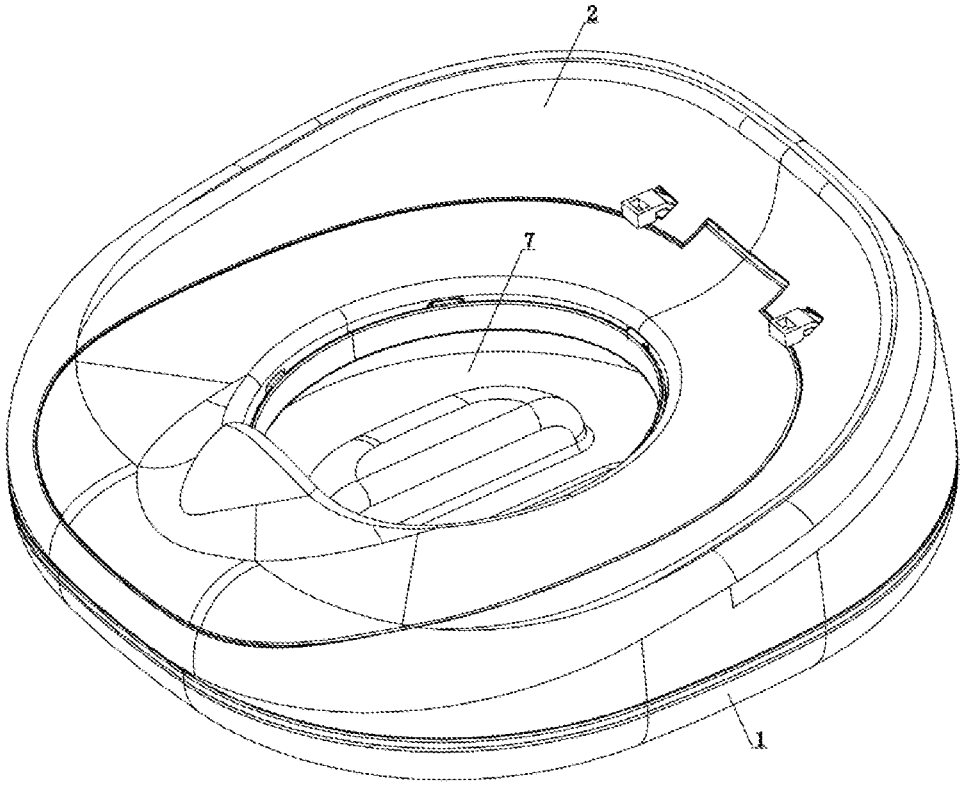
FIG. 2 is a structural diagram of the present invention with a cover plate removed.
Figure 3:
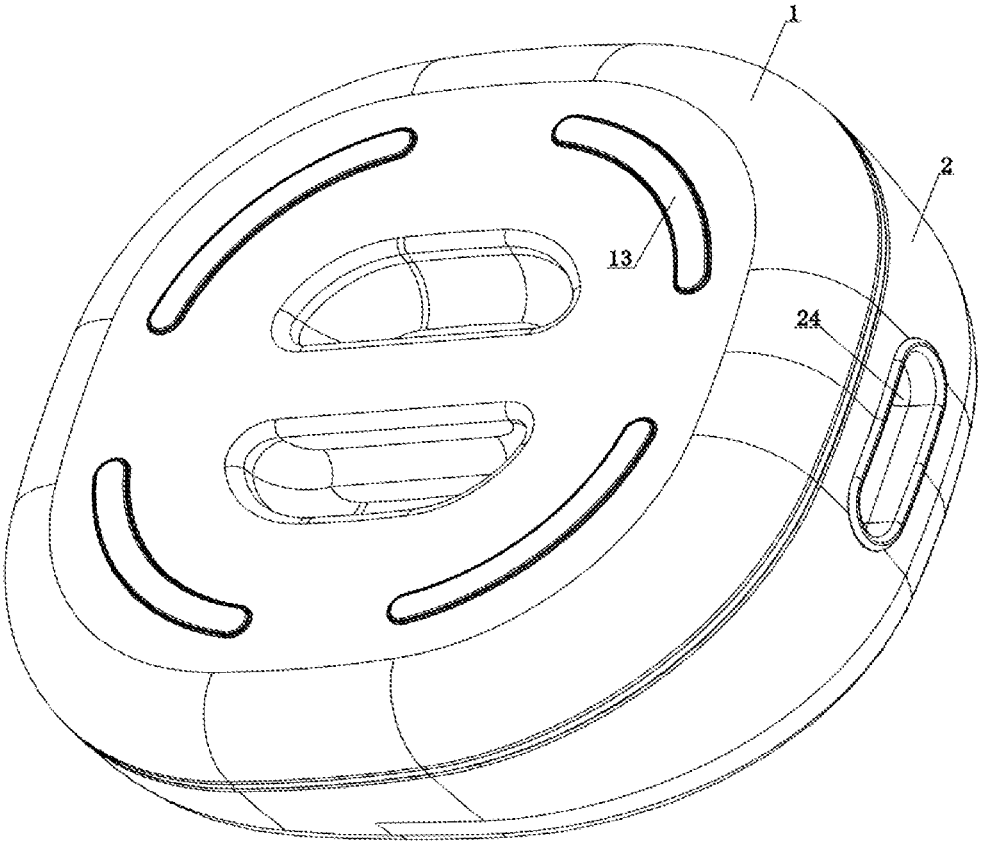
FIG. 3 is a structural diagram of the present invention from another angle of view.
Figure 4:
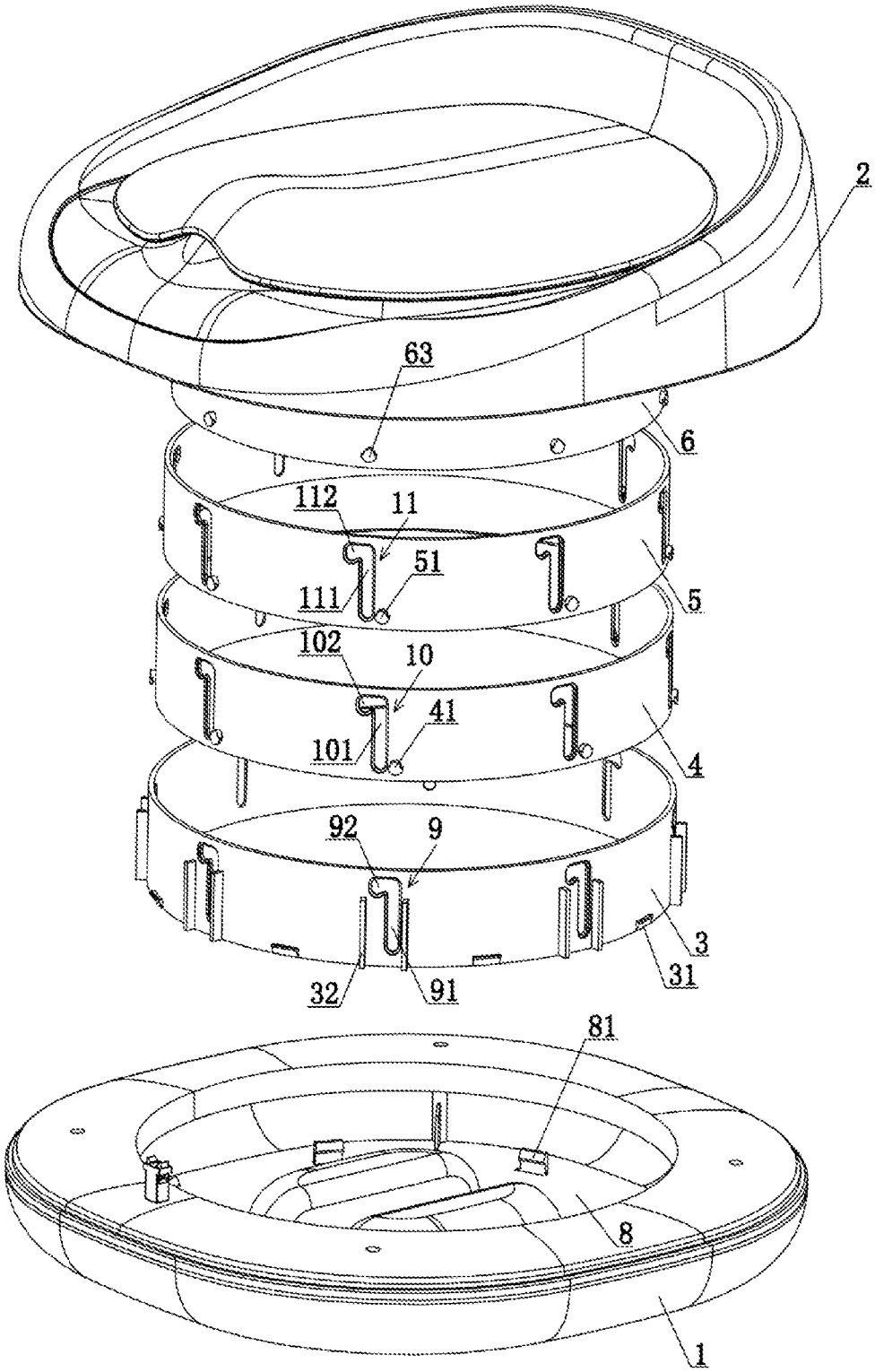
FIG. 4 is an exploded view of the present invention.

Referring to FIGS. 1, 2 and 4, a telescopic toilet for children includes the base 1 and the seat 2. The first sleeve ring 3 is fixed on the base 1, and the second sleeve ring 4 is provided in the first sleeve ring 3. The second sleeve ring 4 is liftable relative to the first sleeve ring 3. The third sleeve ring 5 is provided in the second sleeve ring 4, and the third sleeve ring 5 is liftable relative to the second sleeve ring 4. The fourth sleeve ring 6 is provided in the third sleeve ring 5. The bottom of the seat 2 is fixedly connected to the fourth sleeve ring 6, and the fourth sleeve ring 6 is liftable relative to the third sleeve ring 5. The seat 2 is provided with the toilet bowl opening 7.

Figure 5:
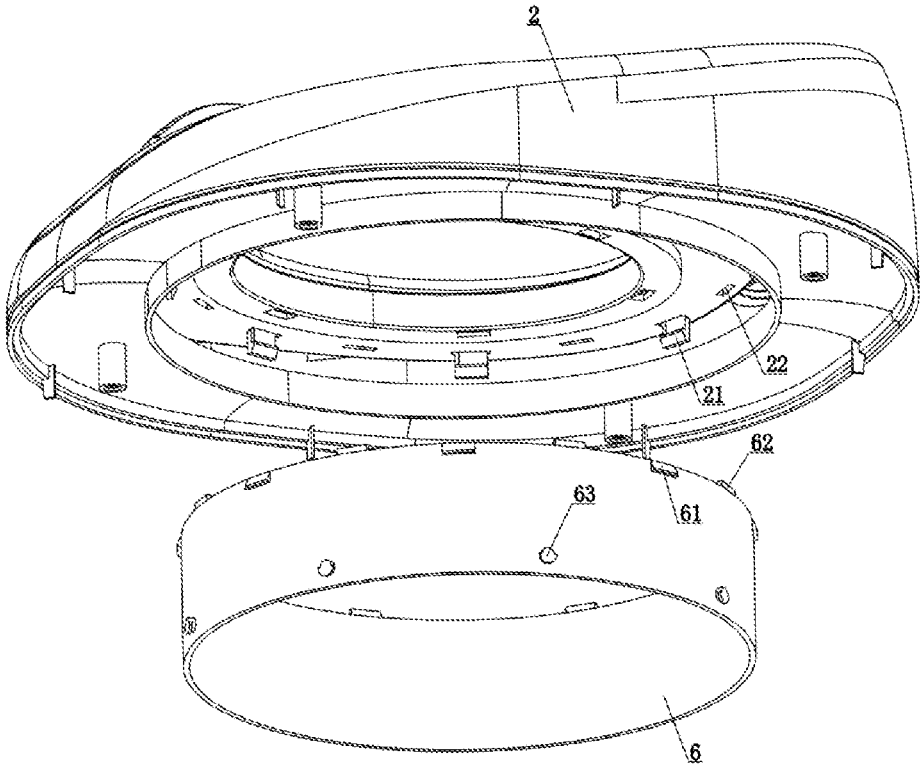
FIG. 5 is an exploded view of a seat and a fourth sleeve ring of the present invention.

Referring to FIGS. 4 and 5, the top surface of the base 1 is provided with the receiving groove 8, and a plurality of first hooks 81 are provided in the receiving groove 8. The lower part of the first sleeve ring 3 is located in the receiving groove 8, and the bottom periphery of the first sleeve ring 3 is provided with a plurality of first clamping parts 31. Each first hook 81 corresponds to one first clamping part 31, and each first hook 81 is configured to hook the top surface of the corresponding first clamping part 31. The top periphery of the fourth sleeve ring 6 is provided with a plurality of second clamping parts 61, and the top surface of the fourth sleeve ring 6 is provided with a plurality of inserting parts 62. The bottom of the seat 2 is provided with a plurality of second hooks 21 and a plurality of slots 22. Each second hook 21 corresponds to one second clamping part 61, and each second hook 21 is configured to hook the bottom surface of the corresponding second clamping part 61. Each inserting part 62 corresponds to one slot 22, and each inserting part 62 is inserted into the corresponding slot 22.

Referring to FIG. 4, a plurality of first sliding slots 9 are evenly distributed on the periphery of the first sleeve ring 3. The first sliding slot 9 includes the first vertical sliding slot 91 and the first arc-shaped sliding slot 92 located on one side of the first vertical sliding slot 91. The first arc-shaped sliding slot 92 is connected to the top of the first vertical sliding slot 91 through an arc transition. A plurality of first protruding columns 41 are evenly distributed on the lower periphery of the second sleeve ring 4, and each first protruding column 41 corresponds to one first sliding slot 9. The first protruding column 41 is liftable in the first vertical sliding slot 91 and can be engaged in the first arc-shaped sliding slot 92.

Referring to FIG. 4, a plurality of second sliding slots 10 are evenly distributed on the periphery of the second sleeve ring 4. The second sliding slot 10 includes the second vertical sliding slot 101 and the second arc-shaped sliding slot 102 located on one side of the second vertical sliding slot 101. The second arc-shaped sliding slot 102 is connected to the top of the second vertical sliding slot 101 through an arc transition. A plurality of second protruding columns 51 are evenly distributed on the lower periphery of the third sleeve ring 5, and each second protruding column 51 corresponds to one second sliding slot 10. The second protruding column 51 is liftable in the second vertical sliding slot 101 and can be engaged in the second arc-shaped sliding slot 102.

Referring to FIG. 4, a plurality of third sliding slots 11 are evenly distributed on the periphery of the third sleeve ring 5. The third sliding slot 11 includes the third vertical sliding slot 111 and the third arc-shaped sliding slot 112 located on one side of the third vertical sliding slot 111. The third arc-shaped sliding slot 112 is connected to the top of the third vertical sliding slot 111 through an arc transition. A plurality of third protruding columns 63 are evenly distributed on the lower periphery of the fourth sleeve ring 6, and each third protruding column 63 corresponds to one third sliding slot 11. The third protruding column 63 is liftable in the third vertical sliding slot 111 and can be engaged into the third arc-shaped sliding slot 112.

Figure 6:
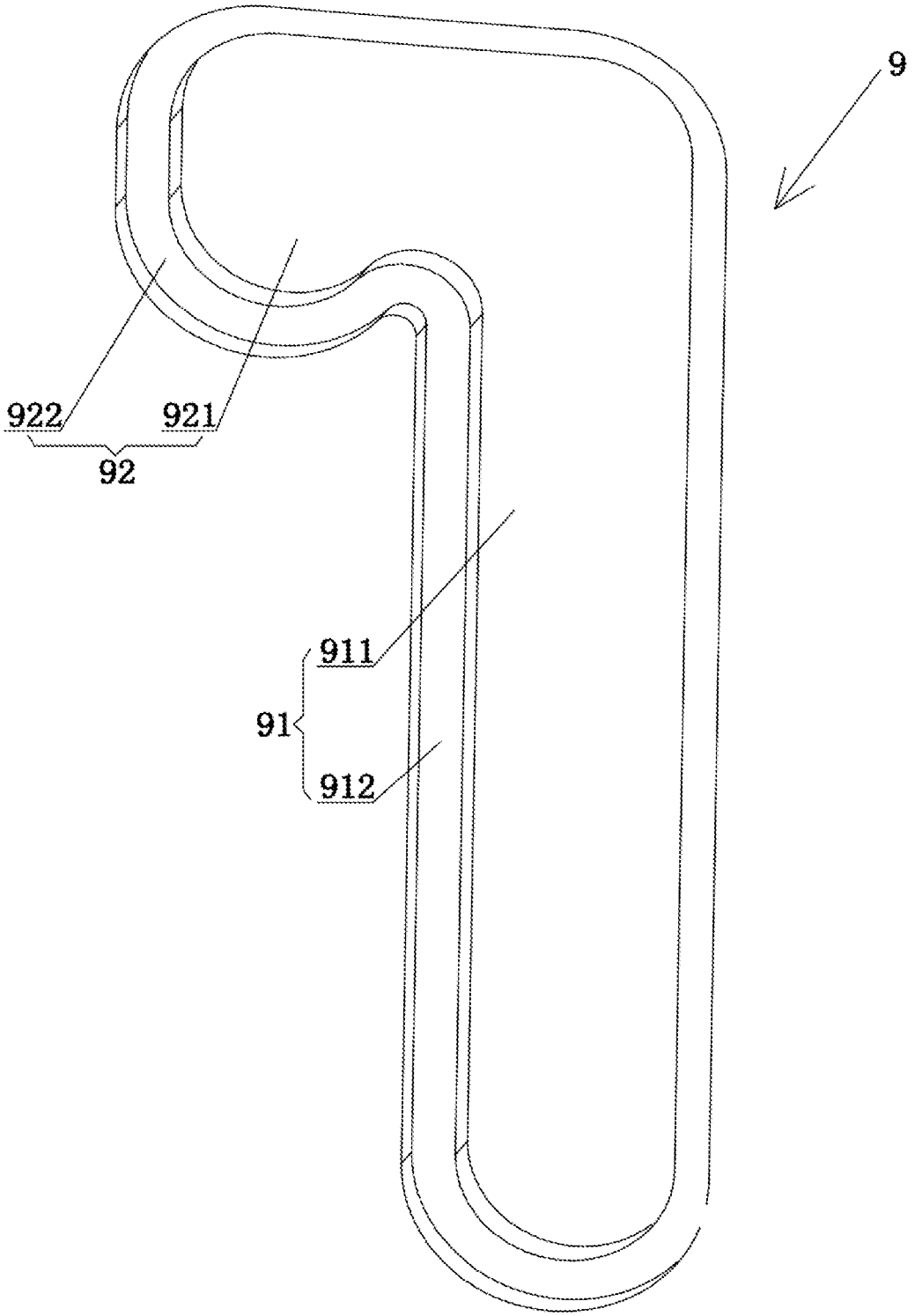
FIG. 6 is a structural diagram of the first sliding slot to the third sliding slot of the present invention.
Figure 7:
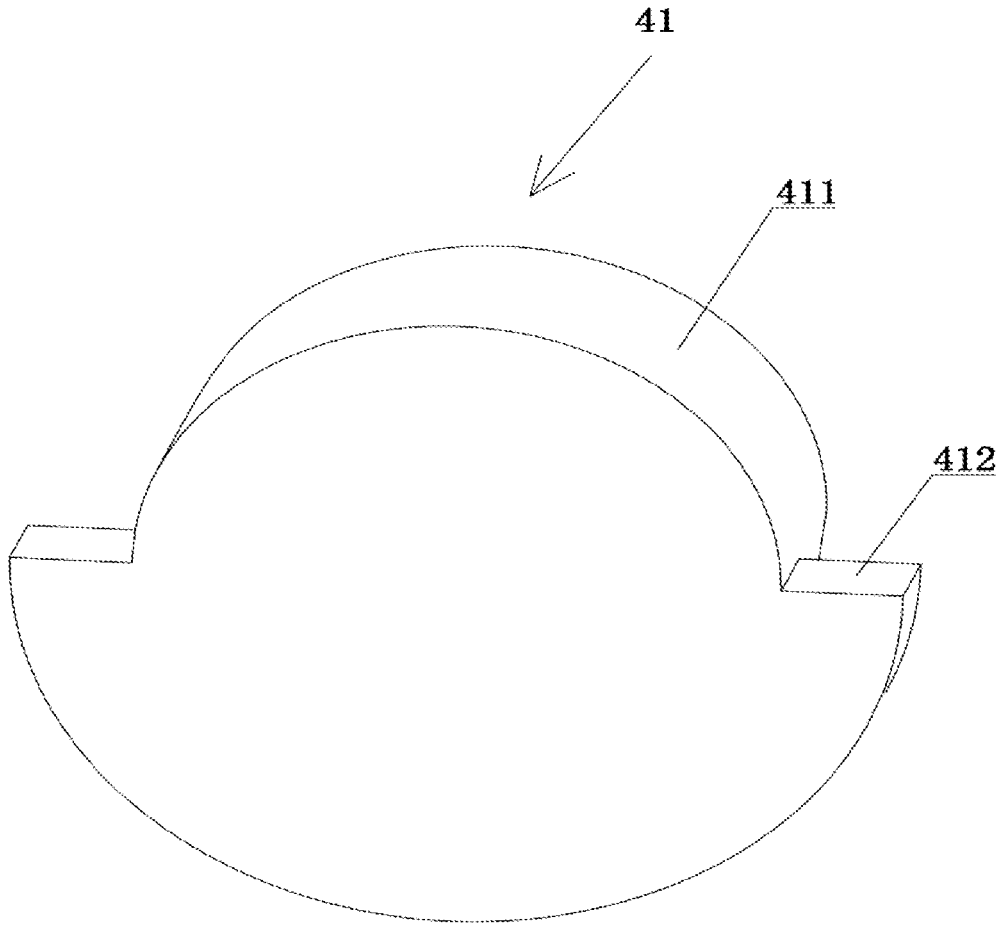
FIG. 7 is a structural diagram of the first protruding column to the third protruding column of the present invention.

Referring to FIGS. 4, 6 and 7, each of the first protruding column 41, the second protruding column 51, and the third protruding column 63 includes the cylinder 411 and the semicircular part 412 provided at the lower half of the front end of the cylinder 411. The diameter of the semicircular part 412 is greater than the diameter of the cylinder 411. Each of the first vertical sliding slot 91, the second vertical sliding slot 101, and the third vertical sliding slot 111 includes the vertical cylinder sliding slot 911 and the vertical semicircular part sliding slot 912. The vertical cylinder sliding slot 911 fits with the cylinder 411, and the vertical semicircular part sliding slot 912 fits with the semicircular part 412. Each of the first arc-shaped sliding slot 92, the second arc-shaped sliding slot 102, and the third arc-shaped sliding slot 112 includes the cylinder arc-shaped sliding slot 921 and the semicircular part arc-shaped sliding slot 922. The cylinder arc-shaped sliding slot 921 fits with the cylinder 411, and the semicircular part arc-shaped sliding slot 922 fits with the semicircular part 412. The cylinder arc-shaped sliding slot 921 is connected to the vertical cylinder sliding slot 911 through an arc transition, and the semicircular arc-shaped sliding slot 922 is connected to the vertical semicircular part sliding slot 912 through an arc transition.

Referring to FIGS. 4, 6 and 7, the fourth sleeve ring 6 is liftable relative to the third sleeve ring 5, the third sleeve ring 5 is liftable relative to the second sleeve ring 4, and the second sleeve ring 4 is liftable relative to the first sleeve ring 3. Exemplified by the fourth sleeve ring 6, when the seat 2 needs to ascend to a higher height level, the seat 2 is first lifted upward so that the third protruding column 63 ascends along the third vertical sliding slot 111. After the third protruding column 63 ascends in place, the seat 2 is rotated clockwise so that the third protruding column 63 is engaged in the third arc-shaped sliding slot 112 to lift the seat 2. Similarly, when the seat 2 descends, the seat 2 is rotated counterclockwise so that the third protruding column 63 is disengaged from the third arc-shaped sliding slot, and then the third protruding column 63 descends along the third vertical sliding slot 111. The lifting principle of the third sleeve ring 5 relative to the second sleeve ring 4 and the second sleeve ring 4 relative to the first sleeve ring 3 is the same as the lifting principle of the fourth sleeve ring 6 relative to the third sleeve ring 5, and thus will not be repeated herein.

Referring to FIGS. 1 to 4, the top surface of the seat 2 is provided with the cover plate 23 for covering the toilet bowl opening 7. The toilet bowl opening 7 is configured to place a toilet bowl adapted to it, and the toilet bowl is an existing common structure and thus will not be repeated herein. The outer periphery of the first sleeve ring 3 is provided with a plurality of sets of support plates 32. When the toilet is telescoped to the lowest height, the plurality of sets of support plates 32 abut against the bottom of the seat 2. The bottom surface of the base 1 is provided with a plurality of anti-slip strips 13 for increasing friction with the floor. The rear end face of the seat part 2 is provided with the handle groove 24 to facilitate carrying the toilet.

The above is only the specific embodiment of the present invention, but the design concept of the present invention is not limited to thereto. Any non-substantial changes made to the present invention by using this concept shall belong to an infringement of the scope of protection of the present invention.

What is claimed is:

1. A telescopic toilet for children, comprising:

a base and a seat;

wherein a first sleeve ring is fixed on the base;

a second sleeve ring is provided in the first sleeve ring, and the second sleeve ring is liftable relative to the first sleeve ring;

a third sleeve ring is provided in the second sleeve ring, and the third sleeve ring is liftable relative to the second sleeve ring;

a fourth sleeve ring is provided in the third sleeve ring;

a bottom of the seat is fixedly connected to the fourth sleeve ring;

the fourth sleeve ring is liftable relative to the third sleeve ring; and the seat is provided with a toilet bowl opening.

2. The telescopic toilet of claim 1, wherein a top surface of the base is provided with a receiving groove, and a plurality of first hooks are provided in the receiving groove;

a lower part of the first sleeve ring is located in the receiving groove, and a bottom periphery of the first sleeve ring is provided with a plurality of first clamping parts;

the plurality of first hooks are in a one-to-one correspondence with the plurality of first clamping parts; and the plurality of first hooks are configured to hook top surfaces of the plurality of first clamping parts.

3. The telescopic toilet of claim 1, wherein a plurality of first sliding slots are evenly distributed on a periphery of the first sleeve ring;

each first sliding slot of the plurality of first sliding slots comprises a first vertical sliding slot and a first arc-shaped sliding slot located on one side of the first vertical sliding slot;

the first arc-shaped sliding slot is connected to a top of the first vertical sliding slot through a first arc transition;

a plurality of first protruding columns are evenly distributed on a lower periphery of the second sleeve ring, and the plurality of first protruding columns are in a one-to-one correspondence with the plurality of first sliding slots; and each first protruding column of the plurality of first protruding columns is liftable in the first vertical sliding slot and the each first protruding column is engaged in the first arc-shaped sliding slot.

4. The telescopic toilet of claim 3, wherein a plurality of second sliding slots are evenly distributed on a periphery of the second sleeve ring;

each second sliding slot of the plurality of second sliding slots comprises a second vertical sliding slot and a second arc-shaped sliding slot located on one side of the second vertical sliding slot;

the second arc-shaped sliding slot is connected to a top of the second vertical sliding slot through a second arc transition;

a plurality of second protruding columns are evenly distributed on a lower periphery of the third sleeve ring;

the plurality of second protruding columns are in a one-to-one correspondence with the plurality of second sliding slots; and each second protruding column of the plurality of second protruding columns is liftable in the second vertical sliding slot and the each second protruding column is engaged in the second arc-shaped sliding slot.

5. The telescopic toilet of claim 4, wherein a plurality of third sliding slots are evenly distributed on a periphery of the third sleeve ring;

each third sliding slot of the plurality of third sliding slots comprises a third vertical sliding slot and a third arc-shaped sliding slot located on one side of the third vertical sliding slot;

the third arc-shaped sliding slot is connected to a top of the third vertical sliding slot through a third arc transition;

a plurality of third protruding columns are evenly distributed on a lower periphery of the fourth sleeve ring, and the plurality of third protruding columns are in a one-to-one correspondence with the plurality of third sliding slots; and each third protruding column of the plurality of third sliding slots is liftable in the third vertical sliding slot and the each third protruding column is engaged in the third arc-shaped sliding slot.

6. The telescopic toilet of claim 5, wherein each of the each first protruding column, the each second protruding column and the each third protruding column comprises a cylinder and a semicircular part provided at a lower half of a front end of the cylinder;

wherein a diameter of the semicircular part is greater than a diameter of the cylinder;

each of the first vertical sliding slot, the second vertical sliding slot and the third vertical sliding slot comprises a vertical cylinder sliding slot and a vertical semicircular part sliding slot, wherein the vertical cylinder sliding slot fits with the cylinder, and the vertical semicircular part sliding slot fits with the semicircular part;

each of the first arc-shaped sliding slot, the second arc-shaped sliding slot and the third arc-shaped sliding slot comprises a cylinder arc-shaped sliding slot and a semicircular part arc-shaped sliding slot, wherein the cylinder arc-shaped sliding slot fits with the cylinder, and the semicircular part arc-shaped sliding slot fits with the semicircular part;

the cylinder arc-shaped sliding slot is connected to the vertical cylinder sliding slot through a fourth arc transition, and the semicircular part arc-shaped sliding slot is connected to the vertical semicircular part sliding slot through a fifth arc transition.

7. The telescopic toilet of claim 1, wherein a top periphery of the fourth sleeve ring is provided with a plurality of second clamping parts;

a top surface of the fourth sleeve ring is provided with a plurality of inserting parts;

the bottom of the seat is provided with a plurality of second hooks and a plurality of slots;

the plurality of second hooks are in a one-to-one correspondence with the plurality of second clamping parts, and the plurality of second hooks are configured to hook bottom surfaces of the plurality of second clamping parts;

the plurality of inserting parts are in a one-to-one correspondence with the plurality of slots, and the plurality of inserting parts are inserted into the plurality of slots.

8. The telescopic toilet of claim 1, wherein a top surface of the seat is provided with a cover plate for covering the toilet bowl opening.

9. The telescopic toilet of claim 1, wherein a plurality of sets of support plates are arranged on a periphery of the first sleeve ring, and the plurality of sets of support plates abut against the bottom of the seat.

10. The telescopic toilet of claim 1, wherein a bottom surface of the base is provided with a plurality of anti-slip strips, and a rear end surface of the seat is provided with a handle groove.

* * * * *